US006327775B1

(12) United States Patent
Oishi et al.

(10) Patent No.: US 6,327,775 B1
(45) **Date of Patent: *Dec. 11, 2001**

(54) TERMINAL CRIMPING UNIT

(75) Inventors: Akinori Oishi; Mamoru Takubo; Atsuo Nakamura; Tsuyoshi Koike; Haruhito Kobayashi, all of Yokkaichi (JP)

(73) Assignee: Sumitomo Wiring Systems, Ltd., Yokkaichi (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/899,114

(22) Filed: Jul. 23, 1997

(30) Foreign Application Priority Data

Jul. 31, 1996 (JP) ..... 8-202444

(51) Int. Cl.[7] ..... H01R 43/048; H01R 43/058; B21C 1/00

(52) U.S. Cl. ..... 29/751; 29/753; 29/863; 29/760; 29/33 M; 72/413; 72/712

(58) Field of Search ..... 29/751, 753, 861, 29/863, 759, 760, 33 M; 72/413, 712, 481.1

(56) References Cited

U.S. PATENT DOCUMENTS

| | | | | |
|---|---|---|---|---|
| 3,931,671 | | 1/1976 | Dittmann . | |
| 3,965,559 | | 6/1976 | Mazzola . | |
| 4,019,362 | * | 4/1977 | McKeever | 29/753 |

(List continued on next page.)

FOREIGN PATENT DOCUMENTS

| | | | | |
|---|---|---|---|---|
| 951885 | * | 7/1974 | (CA) | 29/753 |
| 0600416 | * | 6/1994 | (EP) . | |
| 0711010 | * | 5/1996 | (EP) . | |
| 2524726 | | 10/1983 | (FR) . | |
| 2553683 | * | 4/1985 | (FR) . | |
| 2643514 | * | 8/1990 | (FR) | 29/753 |
| 62175685 | | 11/1987 | (JP) . | |
| 4-46388 | | 4/1992 | (JP) . | |
| 6251850 | | 9/1994 | (JP) . | |
| 6275363 | * | 9/1994 | (JP) . | |
| 07-45352 | * | 2/1995 | (JP) . | |

OTHER PUBLICATIONS

A Partial translation of "Chambrey" FR 2553 683 A, published Apr. 26, 1985, submitted in the Information Disclosure Statement filed Jan. 26, 1998.

Copy of a Search Report issued by the European Patent Office in related Application No. EP 97304826, dated Mar. 25, 1998.*

Copy of a Patent Abstracts of Japan vol. 95, No. 5, published Jun. 30, 1995 of JP 07–045352.*

A European Search Report issued with EP Application No. 97305615.

Patent Abstracts of Japan vol. 18, No. 681 (E–1649), issued Dec. 21, 1994.

*Primary Examiner*—Lee Young
*Assistant Examiner*—A. Dexter Tugbang
(74) *Attorney, Agent, or Firm*—Greenblum & Bernstein, P.L.C.

(57) ABSTRACT

A terminal crimping unit providing improved functionality. The pressuring unit is installed on the terminal crimping unit. The pressuring unit is equipped with a plural number of pressure members for crimping the terminal fittings. The plural number of pressure members are unified in one frame body. The frame body is designed such that can be taken off and put on as one unit from the shank. By having only one motion for putting on and taking off the frame body, the plural number of pressuring members, including the crimpers, can be maintained as one unit.

8 Claims, 12 Drawing Sheets

U.S. PATENT DOCUMENTS 4,025,999 * 5/1977 Wolyn et al. ..... 29/751
4,118,971 * 10/1978 Izraeli ..... 72/413
4,617,731 * 10/1986 Carrell et al. ..... 29/861
4,847,992 * 7/1989 Sato et al. ..... 29/861
4,850,905 * 7/1989 Capp et al. ..... 29/863
5,018,270 * 5/1991 Caumanns ..... 29/863
5,142,765 * 9/1992 Tanaka ..... 29/564.6
5,357,669 * 10/1994 Orphanos et al. ..... 29/753
5,491,887 * 2/1996 Quinn ..... 29/753
5,575,061 * 11/1996 Tsuji et al. ..... 29/33 M
5,661,898 * 9/1997 Matsuzawa ..... 29/753
5,765,278 * 6/1998 Koike et al. ..... 29/753
5,799,391 * 9/1998 Tillotson ..... 72/712
5,852,868 * 12/1998 Soriano ..... 29/753
5,967,395 10/1999 Ito .

* cited by examiner

TERMINAL CRIMPING UNIT

BACKGROUND OF THE INVENTION

1. Field of the Invention

The present invention relates to an improved terminal crimping unit wherein the pressure-receiving unit includes several pressure members which can be easily put on and taken off as one unit without the use of tools.

2. Description of Background Information

It is known to have a terminal crimping unit for continuously crimping terminal fittings on the end part of an electric wire. Japanese Application Patent Publication (Unexamined) No. SHO 62-175685), in fact, reflects such equipment. The terminal crimping unit includes a terminal belt feed mechanism for feeding the terminal belt and a press mechanism for severing the terminal fittings from the terminal belt feed and crimping it on an electric wire. The crimping process is continuously and automatically performed by linking these mechanisms.

As disclosed in Japanese Application Patent Publication (Unexamined) No. SHO 62-175685, the main body of the applicator and the anvil are formed separately and the main body is made such that it universally fits many types of anvils.

This method has recently proved disadvantageous, however, because the types of terminal fittings used in the crimping process have noticeably increased. Thus, merely exchanging the anvil is no longer sufficient to make the press mechanism universal. Rather, the process for fitting a crimping terminal requires several additional members, including: a member for caulking the electric wire barrel of the terminal fittings, a member for caulking a coating barrel, a member for severing the terminal fittings from the carrier of a terminal belt and the like, a plural number of pressure members and pressure-receiving members. It would, thus, be advantageous to be able to easily and quickly change a plural number of these members to match the respective type of terminal fitting when the anvil is changed to corresponding to the respective type of terminal fitting or when the anvil is repaired upon the anvil's failure. Yet, such a functional improvement has not been proposed in conventional equipment.

SUMMARY OF THE INVENTION

The present invention was designed to overcome the above-mentioned disadvantages. The goal of the present invention is to provide a terminal crimping unit with increased suitability for universally corresponding to a greater number of types of terminal fittings.

To overcome the above-mentioned disadvantage, the present invention includes a terminal crimping unit wherein the pressure-receiving unit can be taken off and put on as one unit. The pressure-receiving unit includes at least the anvil that receives the terminal fittings against the main body, and further includes: a plural number of pressure members containing at least a crimper for crimping the terminal fittings with an anvil of the pressure-receiving unit; a shank driving pressure members for allowing the pressure-receiving members to receive a pressing motion; and a frame body support the pressure members in one unit and removably connecting the supported pressure members with the shank.

In the present invention, a plural number of the pressure members including a crimper can be affixed and removed as a single unit against the shank by only affixing and removing the frame body on the shank. The pressure members include crimpers such as an electric wire crimper, coating crimper and the like. The pressure members also include a correcting member for correcting the deformation of terminal fittings, and a punch to sever the terminal fittings from the terminal belt and the like.

Further, a preferred embodiment of the invention includes a terminal crimping unit that includes a receiving face for receiving a carrier in a terminal belt mechanism wherein the terminal fittings continue in parallel at some intervals. The receiving face further includes a protruding face extending perpendicular to the receiving face and positioned against the terminal fittings of the carrier; and a rolling member having a contact part contacting with the carrier by rolling and sending the carrier to the anvil of the pressure-receiving unit while pushing it on the protruding face by clamping the carrier between the contact part and the receiving face.

Another aspect of the invention includes a nip. The nip is formed by the carrier being positioned between the contact part of the rolling member and the receiving face. The carrier on the terminal belt is fed by nipping the carrier in the feeding direction along the receiving face and being pushed onto the protruding face. Thus, the carrier can be fed to the anvil of the receiving unit where the terminal fittings are severed from the terminal belt. The receiving face may be one receiving the upper face of the carrier and one receiving the lower face.

Another preferred embodiment of the invention includes a terminal crimping unit that includes a pair of rollers for clamping a carrier to a terminal belt wherein terminal fittings continue in parallel at some intervals; and a servomotor driving one of the pair of rollers so that the pair of rollers send and feed the carrier to the anvil of the pressure-receiving unit; a controlling procedure for controlling the rotation of a servomotor so that the terminal fittings are sent and fed when the terminal crimping unit is not operating.

Another aspect of the invention includes the pair of rollers driven by the servomotor that is controlled by a controlling procedure and which feed the carrier in the fixed feeding direction by nipping the carrier. Using this mechanism, it is possible to feed the terminal belt when the pressure-receiving unit and the pressuring unit that constitute the press mechanism are automatically separated.

Another preferred embodiment includes a terminal crimping unit that includes a terminal belt feed mechanism for feeding a carrier in a terminal belt wherein terminal fittings continue in parallel at some intervals while maintaining position; a rail member installed at the terminal belt feed mechanism and a main body block. The terminal belt feed mechanism extends in a direction perpendicular to the carrier. The terminal belt mechanism further includes a slider wherein the terminal belt feed mechanism and the main body block connect both members along the rail member. By being installed at the rail member and supporting the terminal belt feed mechanism and the other main body block, the connection maintains a relative position-change. The terminal belt feed mechanism further includes a lock mechanism so that the relative position of the slider and the rail member may be finely adjustable.

In another preferred embodiment of the invention, when changing the pressure-receiving unit and the pressuring unit according to the type of terminal fittings, the feeding position of the terminal belt can be finely adjusted to accord with the respective changed units. Further, another preferred embodiment of the invention includes a terminal crimping unit that includes an anvil that includes a plural kind of pressure-receiving units formed in response to the type of terminal fittings which should be crimped, and the pressure-receiving unit contains an anvil holder retaining in a state of alternatively positioning the pressure-receiving of the anvil at the crimping position of the terminal fittings.

In another preferred embodiment of the invention, the terminal crimping work can be performed by alternatively utilizing a plural number of the pressure-receiving faces formed on the same anvil.

In one preferred embodiment of the invention, the terminal crimping unit includes a plurality of pressure members including at least a crimper for crimping a terminal fitting, and a pressure-receiving member including an anvil. The pressure members cooperate with the pressure-receiving member to receive a pressing motion. The terminal crimping unit further includes a frame body to support the pressure member as a unit. The frame body removably connects the supported pressure member to the shank and the pressure-receiving member is removable as a unit.

Another aspect of the invention further includes a terminal crimping unit that includes a receiving face for receiving a terminal carrier. The terminal carrier includes spaced and parallel terminal fittings. The terminal crimping unit further includes a protruding face that extends in a direction perpendicular to the receiving face and contacts the side edge of the carrier. The terminal crimping unit further includes a roller that includes a contact part that contacts the terminal carrier and feeds the terminal carrier to the anvil of the pressure-receiving member and clamps the terminal carrier between the contact part and the receiving face.

Another aspect of the invention includes a terminal crimping unit that includes a pair of rollers that clamp the terminal carrier. The terminal carrier includes spaced and parallel terminal fitting. A servomotor drives one of the pair of rollers so that the pair of rollers feeds the terminal carrier to the anvil of the pressure-receiving member. This preferred embodiment further includes a controller for controlling the rotation of the servomotor so that the terminal fittings are fed when the terminal crimping unit is not engaged.

Another aspect of the invention includes a terminal crimping unit that includes a terminal belt feed mechanism for feeding a terminal carrier. The terminal carrier includes spaced and parallel terminal fittings and a rail member positioned at one end of the terminal carrier feed mechanism. The main body block extend in a direction perpendicular to the terminal carrier. The terminal belt feed mechanism further includes a slider, wherein the terminal belt feed mechanism and the main body block are connected along the rail member and support the other of the terminal carrier belt feed mechanism and the main body block. The terminal belt feed mechanism further includes a lock mechanism that adjusts the relative position of the slider and the rail member.

Another aspect of the invention includes a terminal crimping unit that includes the anvil that includes plural types of pressure-receiving faces depending on the type of terminal fittings which are to be crimped. The pressure-receiving member includes an anvil holder that retains the pressure-receiving face of the anvil in alternative positions at the crimping position of the terminal fittings.

Another aspect of the invention includes a terminal crimping unit that includes an anvil that includes first pressure-receiving projections that extend perpendicular from a central part of a block part of the anvil and second pressure-receiving projections that extend in the width direction from the central part of the block part. One of the second pressure-receiving projections extends further to one side in the width direction of the block part than the other of the second pressure-receiving projections.

Another aspect of the invention includes a terminal crimping unit that includes feed rollers spaced along a terminal feeding direction forming a nip with a terminal carrier, and a bevel slit on one of the feed rollers. The bevel slit contacts the terminal carrier.

Another aspect of the preferred embodiment includes a terminal crimping unit that includes pressure rollers that are spaced along a terminal feeding direction and form a nip with a terminal carrier. The pressure rollers have a screw groove that contacts the terminal carrier.

Another aspect of the preferred embodiment includes a pressure receiving member for a terminal crimping unit that includes an anvil housing and an anvil. The anvil further includes a block part and first and second pressure-receiving projections that extend vertically from the block part. The anvil further includes at least a third pressure-receiving projection that extends horizontally from the block part. The first and second pressure-receiving projections each include a different pressure-receiving face. The pressure-receiving member further includes an anvil holder. The anvil holder includes a recess that extends vertically to retain at lease one of the first and second pressure-receiving projections of the anvil. The recess extends horizontally to retain at least the third pressure-receiving projection. The anvil can be selectively inserted in the recess so that the pressure-receiving faces can be alternatively positioned.

A preferred embodiment further includes a pressure-receiving member that includes an anvil. The anvil includes a covered wire anvil portion and an electric wire anvil portion. The wire anvil portion and the electric anvil portion include first and second pressure-receiving projections. The first and second pressure-receiving projections each include a different pressure-receiving face.

BRIEF DESCRIPTION OF THE DRAWINGS

The invention will be better understood by referring to the description which follows with reference to the drawings, which illustrate by way of non-limiting examples, embodiments of the invention, with like reference numbers representing similar parts throughout the several views, and wherein.

DETAILED DESCRIPTION OF THE INVENTION

Figure 1:
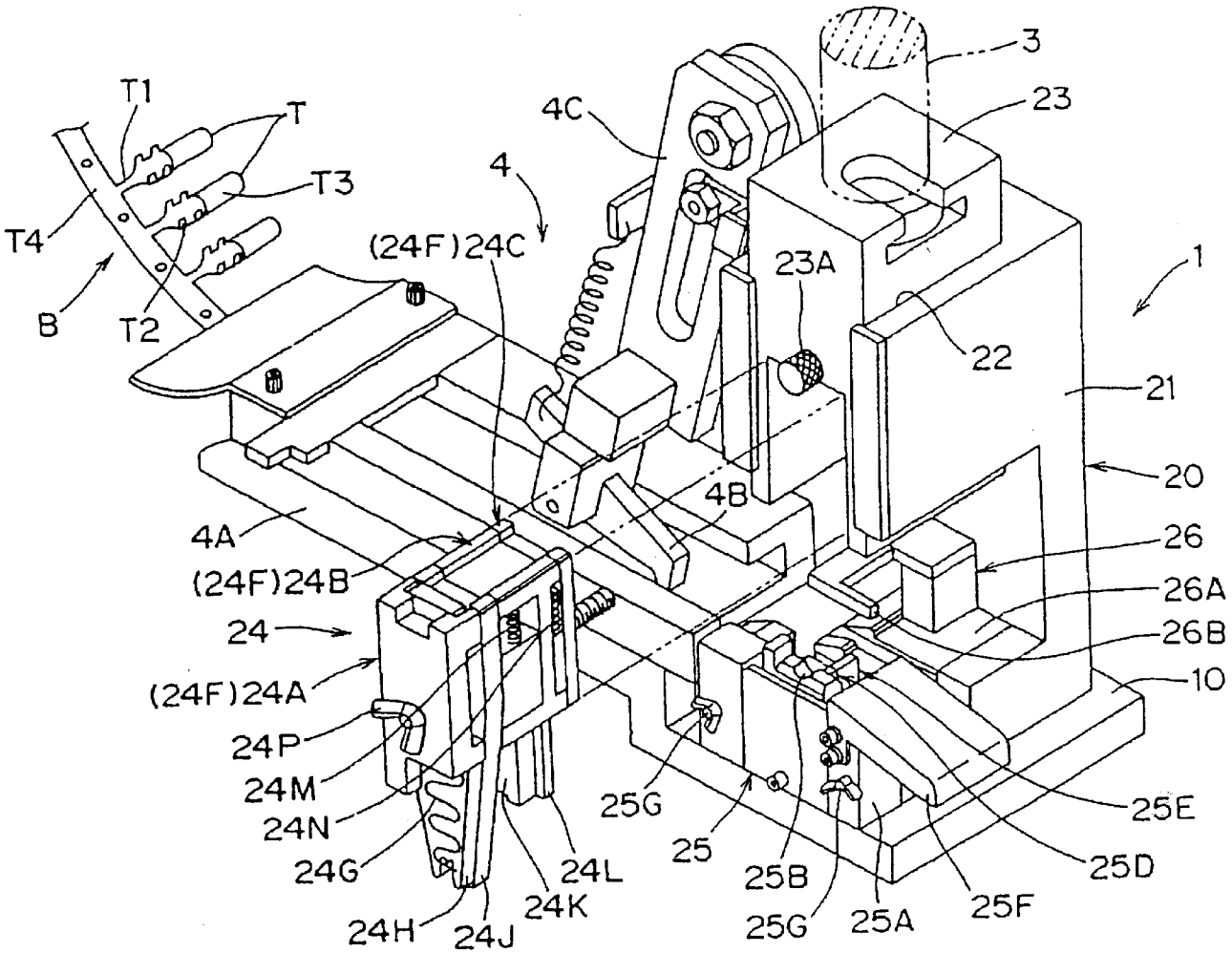
FIG. 1 is a perspective view of a side-feed type terminal crimping unit relating to one preferred embodiment of the present invention.

The preferred embodiment of the invention is illustrated in detail as follows, referring to appended drawings. FIG. 1 is the perspective view of a side-feed type terminal crimping unit 1 relating to a preferred embodiment of the present invention.

Figure 5:
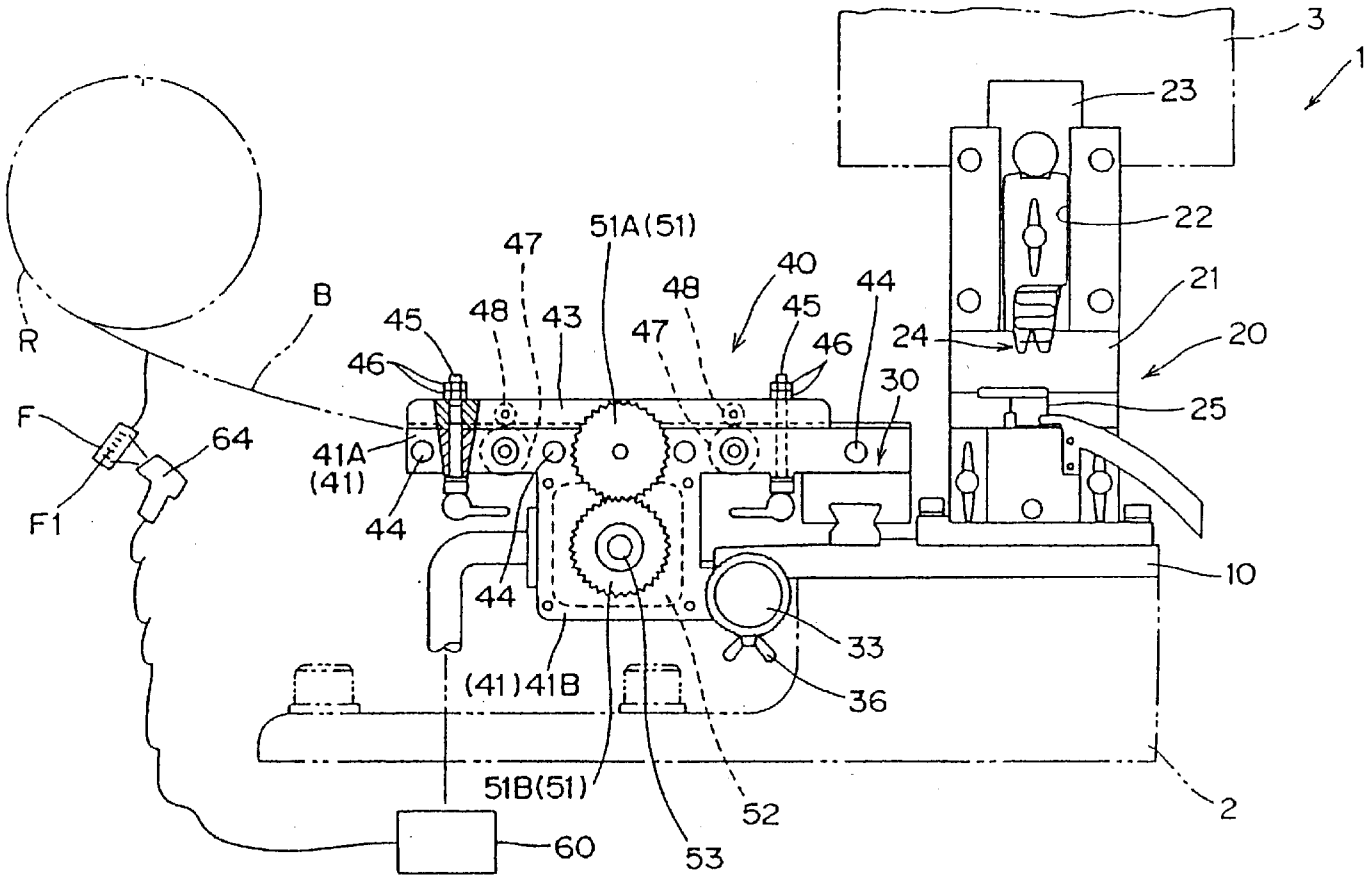
FIG. 5 is a side view of a side-feed type terminal crimping unit relating to a preferred embodiment of the present invention.

As shown in FIG. 1, the preferred embodiment of the invention includes the terminal belt B from which the tie part T1 extends at a fixed interval on one side of the long carrier T4, and connects the terminal fittings T in a body through the tie part T1 such that the tie part T1 extends perpendicular to the longitudinal direction of the carrier T4. The terminal fittings T of the terminal belt B extend from the crimping part T2, which crimping part T2 is intended to be crimped on the end part of a covered electric wire (not illustrated). The terminal fittings T further include the connecting part T3 for being connected with other terminal fittings in a body. Further, the terminal belt B is wound on the reel body R as shown in FIG. 5.

As shown in FIG. 1, the terminal crimping unit 1 is set on the base part 2 of the known automatically length-controlled electric wire production equipment, and includes a fixed base plate 10. The automatically length-controlled electric wire production equipment controls the length of an electric wire by cutting at a predetermined fixed length (the length-controlled electric wire) and by crimping the terminal fittings T on both ends of the electric wire.

At a fixed position on the main body block 21, the terminal belt feed mechanism 4 feeds the terminal belt B to the press mechanism 20 for crimping the terminal fittings T of the terminal belt B.

The terminal belt feed mechanism 4 shown in FIG. 1 is known and includes the assembly plate 4A affixed upon the base plate 10. The terminal belt feed mechanism 4 further includes the feed element 4B for feeding the terminal fittings T one by one by engaging the assembly plate 4A with the terminal fittings T as they pass, and the link lever 4C for interlocking the feed element 4B with the press mechanism 20 described later.

The press mechanism 20 includes the main body block 21 that is positioned perpendicular to the base plate 10. The main body block 21 is a rectangular parallelopiped shaped, and includes the guide groove 22. The guide groove 22 extends upward and downward on the front face of the main body block 21. The guide groove 22 is opened forward, and upward and downward. Further, the shank 23 is connected to the press equipment 3 of the automatically length-controlled electric wire production equipment. The shank 23 is fitted in guide groove 22 and able to slide. The pressuring unit 24 for pressuring the terminal fittings T is connected with the shank 23. FIG. 1 shows the link lever 4C of the terminal belt feed mechanism 4 connected to the shank 23. The terminal fittings T are designed to be fed one by one to the press mechanism 20 when the terminal fittings T are not being crimped to move in response to the up and down motion of the shank 23. On the other hand, the pressure-receiving unit 25 is installed under the lower part of the main body block 21.

Figure 2:
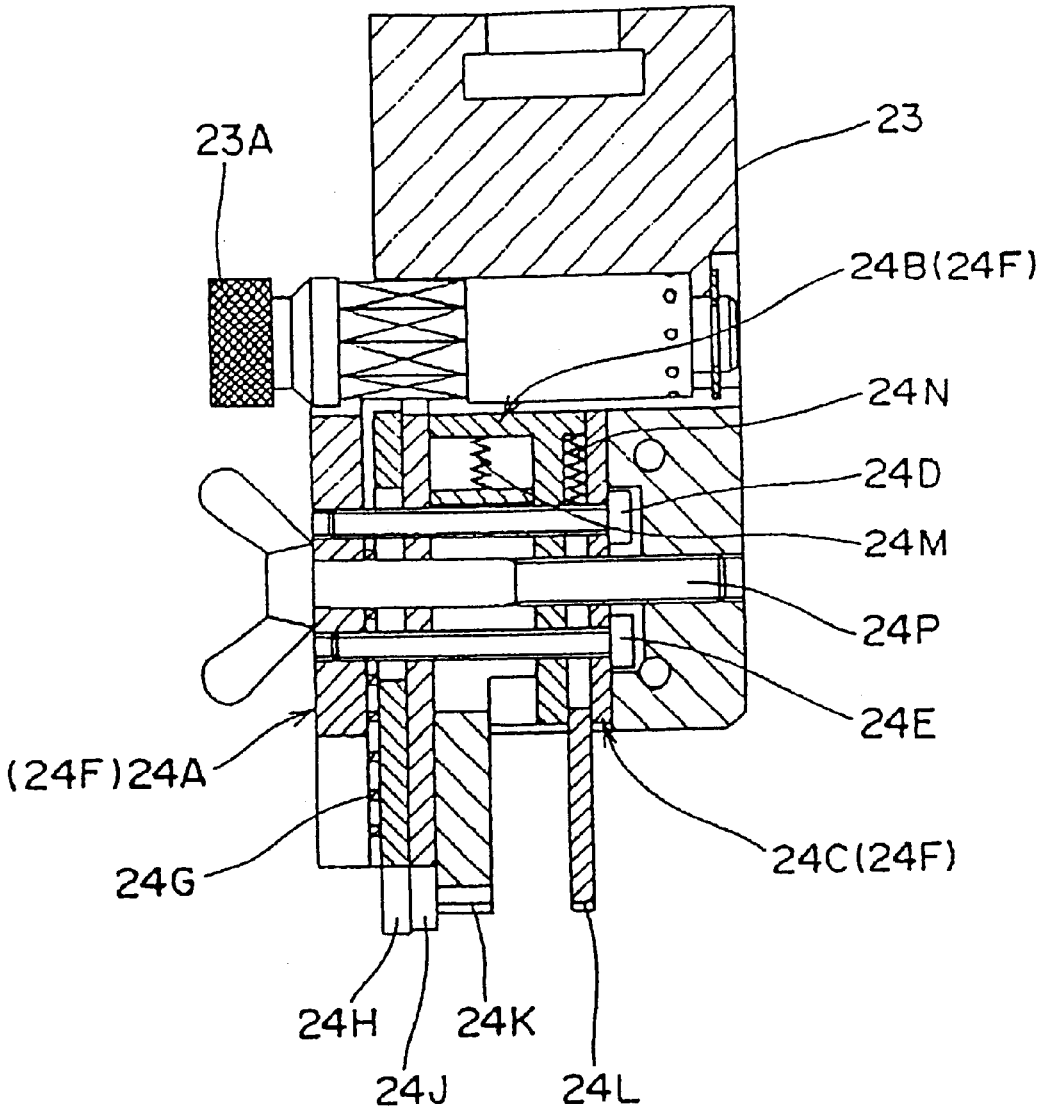
FIG. 2 is the cross sectional side view of an important part of the press mechanism of the terminal crimping unit of FIG. 1.
Figure 3:
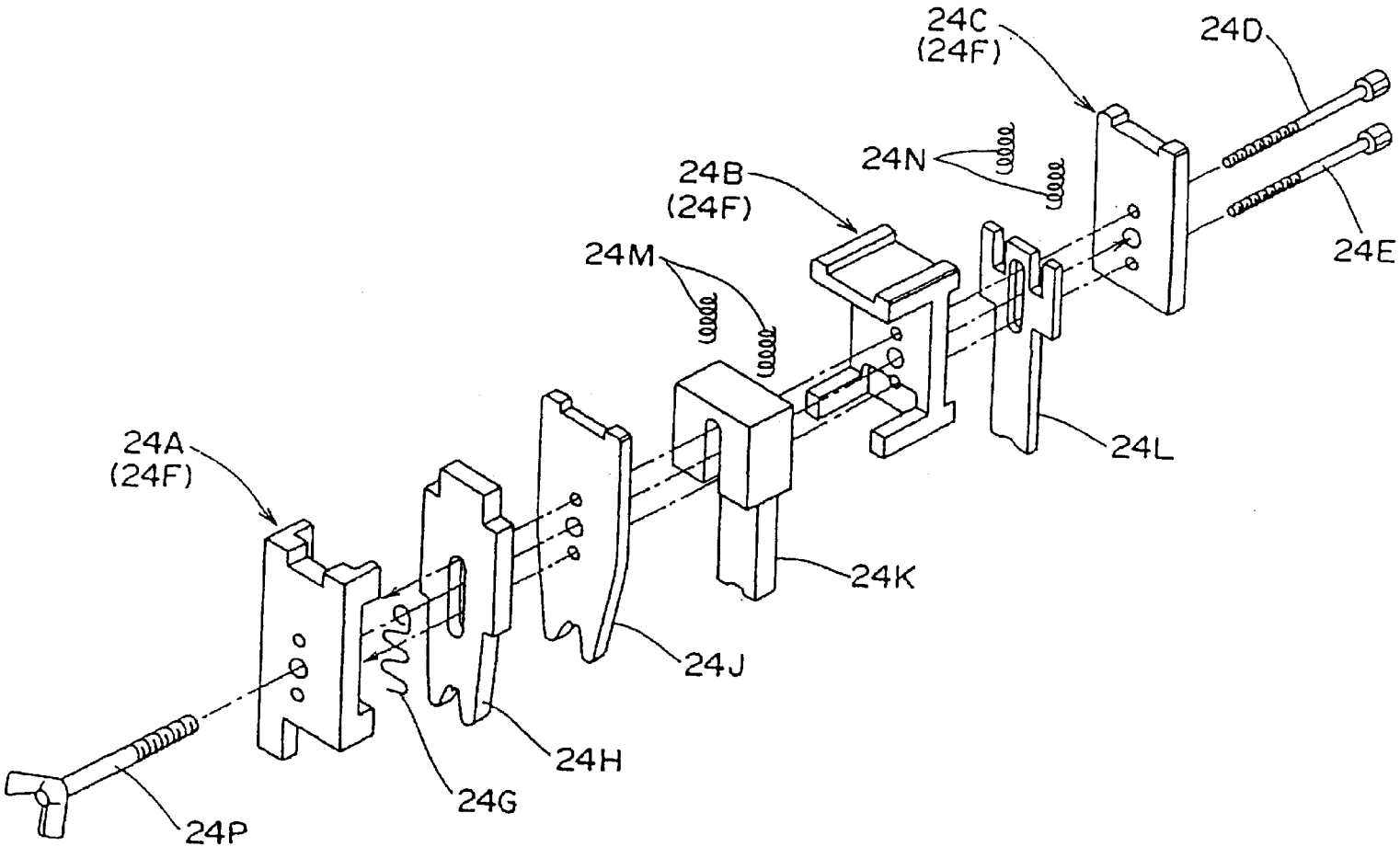
FIG. 3 is the exploded view of the pressuring unit of the terminal crimping unit of FIG. 1.

FIG. 2 is a cross-sectional view of an important part of the press mechanism 20 adapted to the terminal crimping unit 1 of FIG. 1. FIG. 3 is an exploded view of the pressuring unit 24 adapted to the terminal crimping unit 1 of FIG. 1.

Referring to these Figures, the pressuring unit 24 is made into a single unit by affixing the pressuring member necessary for crimping the terminal fittings T to the frame body 24F. In the example shown in FIG. 1, the frame 24F is affixed to the cutting punch 24A that serves as the pressuring member (i.e., since the cutting punch 24A serves as the pressuring member, they are one and the same member, and are therefore necessarily fixed relative to one another) and to the correction guide 24B by a pair of the bolts (e.g., first fasteners) 24D and 24E together with the back plate 24C. The snap spring 24G, as the other pressuring member, the covered crimper 24H, the electric wire crimper 24J, the terminal correction members 24K, 24L and the compressed coil spring 24M are assembled against the frame body 24F and are capable of moving as a unit or relative to each other.

As shown in FIG. 1, the pressuring unit 24 is designed so that by turning the wing bolt (e.g., second fasteners) 24P, the pressuring unit 24 can be manually put on and taken off without using tools for the shank 23. After the pressing unit 24 is installed in the same manner as other well-known pressuring members, the terminal fittings T received on the pressure-receiving unit are severed from the long carrier T4, thus enabling the crimping part T2 to be crimped on the electric wire (which is not illustrated). Further, as shown in FIG. 1 and FIG. 2, the adjusting dial 23A adjusts the height of the covered crimper 24H.

In the example shown in FIG. 1 and FIG. 2, a plural number of the pressuring members 24A to 24N including the crimpers 24H, 24J can be put on and taken off the frame body 24F as a unit against the shank 23, thus facilitating the replacement and maintenance of the pressuring members 24A to 24N such as the crimpers 24H, 24J and the like by being able to prepare a plural number of the pressuring units 24 in accordance with the type of the terminal fittings T which are to be crimped.

As can be clearly seen in FIGS. 2 and 3, each of the pressure members 24A–24C, 24H, and 24J–24L includes a portion which is of a plate form (i.e., with two opposite parallel faces across the thinnest dimension) and thereby stackable. The pressure members 24A–24C, 24H, and 24J–24L are stacked, as clearly shown in FIGS. 2 and 3, with each stackable plate portion parallel to one another, and the first fasteners 24D, 24D are passed therethrough to form the removable unit frame body.

Figure 4:
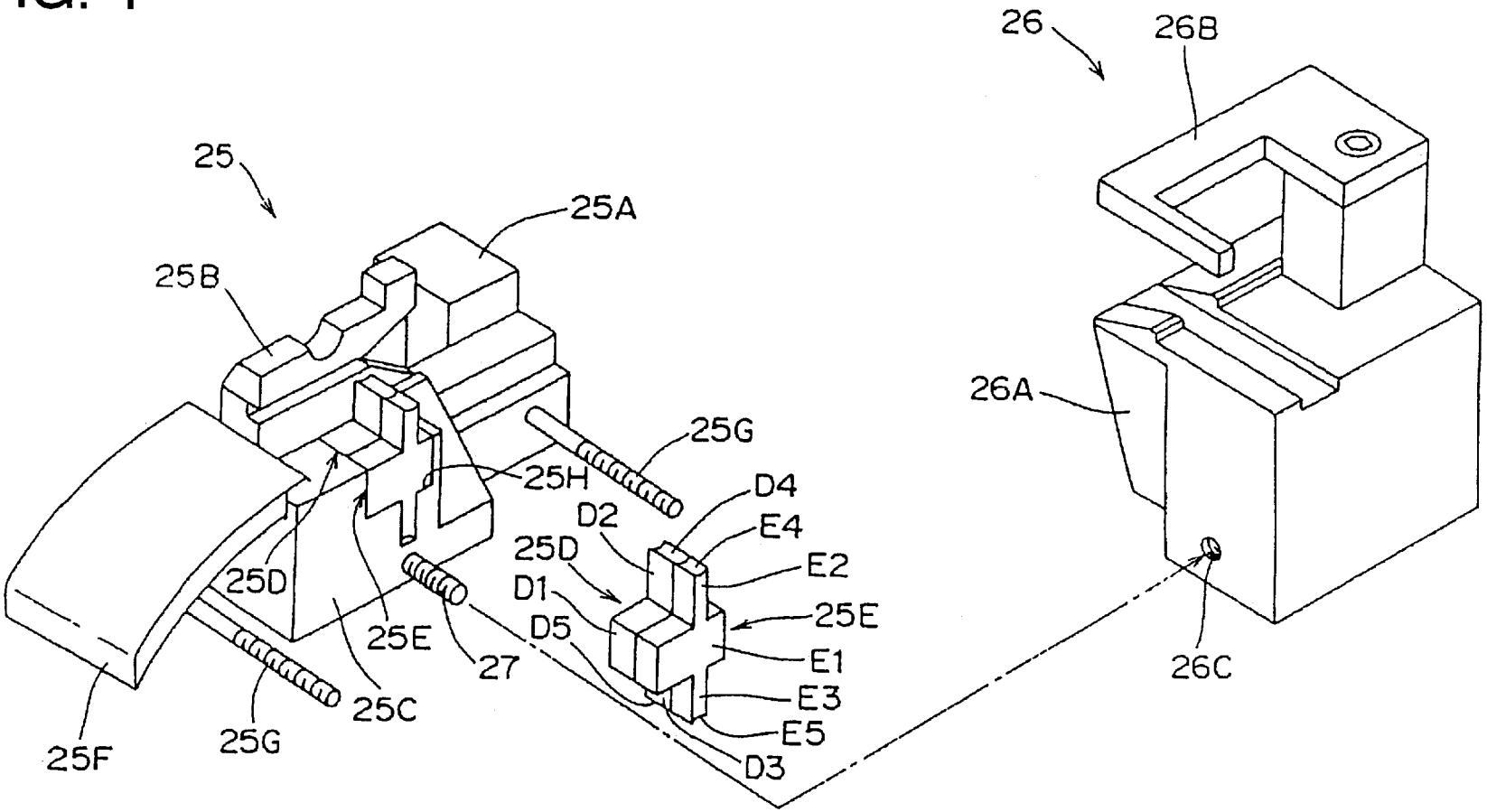
FIG. 4 is the perspective view of the pressuring-receiving unit of the terminal crimping unit of FIG. 1.

FIG. 4 is the perspective view of the pressure-receiving unit adapted to fit the terminal crimping unit 1 of FIG. 1. As shown in the Figure, the pressure-receiving unit 25 was made into one unit by assembling the slide cutter 25B, the anvil holder 25C, the covered anvil 25D, the electric wire anvil 25E, the electric wire guide cover 25F and the like against the anvil housing 25A. The pressure-receiving unit 25 is a basic unit, and is constructed so that, by using a pair of wing bolts 25G, the pressure-receiving unit 25 can be manually put on and taken off the main body block 21 without using a tool, similar to the pressuring unit 24.

As shown in FIG. 4, the respective anvils 25D, 25E include pressure-receiving projections D2, D3, E2, E3 having a cross-shape appearance extending from the rectangular block parts D1, E1. The respective pressure-receiving projections D2, D3, E2, E3 include pressure-receiving faces D4, D5, E4, E5 having different shapes that are formed depending on the type of terminal fittings T which are to be crimped. On the other hand, the anvil holder 25C includes the substantially T-shaped recess 25H which can selectively accommodate the pressure-receiving projections D2, D3, E2, E3 of respective anvils 25D, 25E. Accordingly, in these anvils 25D, 25E, by installing the anvil in the recess part 25H of the anvil holder 25C while turning one side of the pressure-receiving faces D4, E4 (or the pressure-receiving faces D5, E5) upward, it is possible to selectively position a plural number of the pressure-receiving faces D4, E4(D5, E5) at the crimping location of the terminal fittings T (the location shown in FIG. 1).

As FIG. 4 shows, respective pressure-receiving projections D2, D3, E2, E3 extend perpendicular from the central part of the block part D1, E1 and extends further to one side in the width direction of the block part D1, E1.

In this example, because it is possible to perform the terminal crimping work by utilizing a plural number of the pressure-receiving faces D4, D5, E4, E5 formed on the same anvil 25D, 25E, the universal nature of the pressure-receiving unit 25 is improved because it includes fewer components.

FIG. 4 shows the anvil unit 25 which includes the stopper part 26 that prevents the terminal fittings T from following the pressuring unit 24 when the terminal is crimped. This stopper part 26 contains the rectangular block body 26A and the claw part 26B installed on the upper portion of the block body 26A. On the front of the block body 26A, the anvil housing 25A and the block body 26A are joined by threading the bolt 27 to penetrate through the anvil housing 25A into the tapped hole 26C. The claw part 26B is formed in the shape of a "U" and prevents the terminal fittings T from interfering with the pressuring unit 24.

Figure 6:
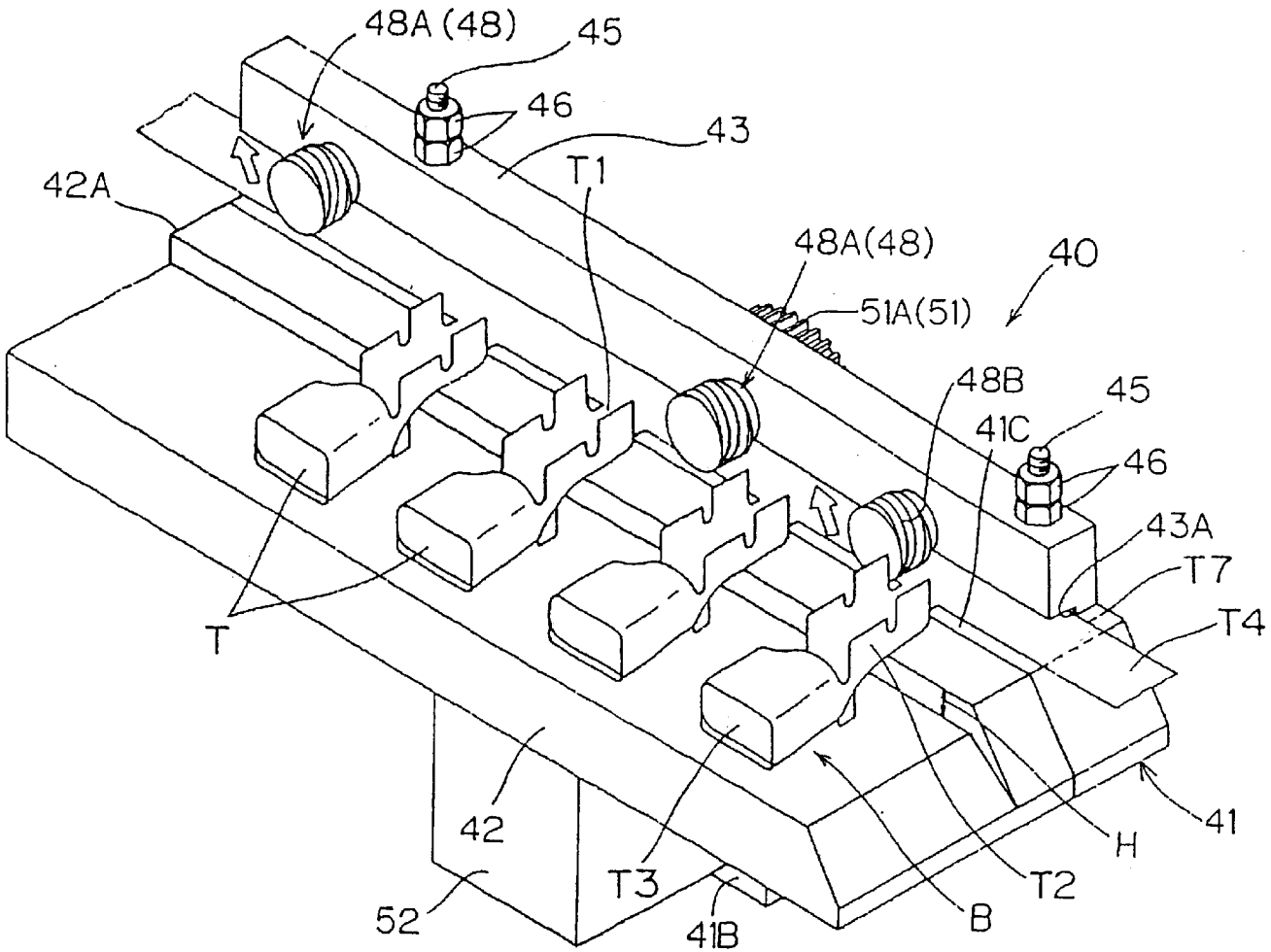
FIG. 6 is a perspective view of an important part of the terminal belt feed mechanism of the terminal crimping unit of FIG. 5.

FIG. 5 illustrates another preferred embodiment of the invention. FIG. 5 is a side view of the terminal side of a feeding type crimping unit 1. FIG. 6 is the perspective view of an important part of the terminal belt feed mechanism 40 adapted to fit in the terminal crimping unit of FIG. 5. The following description uses the same reference numbers as that of FIG. 1 and the common description is only briefly discussed.

As shown in FIG. 5, a preferred embodiment of the invention includes a terminal crimping unit 1 which includes a base plate 10. The base plate 10 is formed in a rectangular shape. The press mechanism 20 is installed at one end of the terminal crimping unit 1 in the same manner as in FIG. 1. At the other end, the terminal belt feed mechanism 40 for feeding the terminal belt B into the press mechanism 20 is connected through the connection mechanism 30. The terminal belt feed mechanism 40 dispenses the terminal belt B from the side face of the press mechanism 20, and supplies the terminal fittings T.

Figure 7:
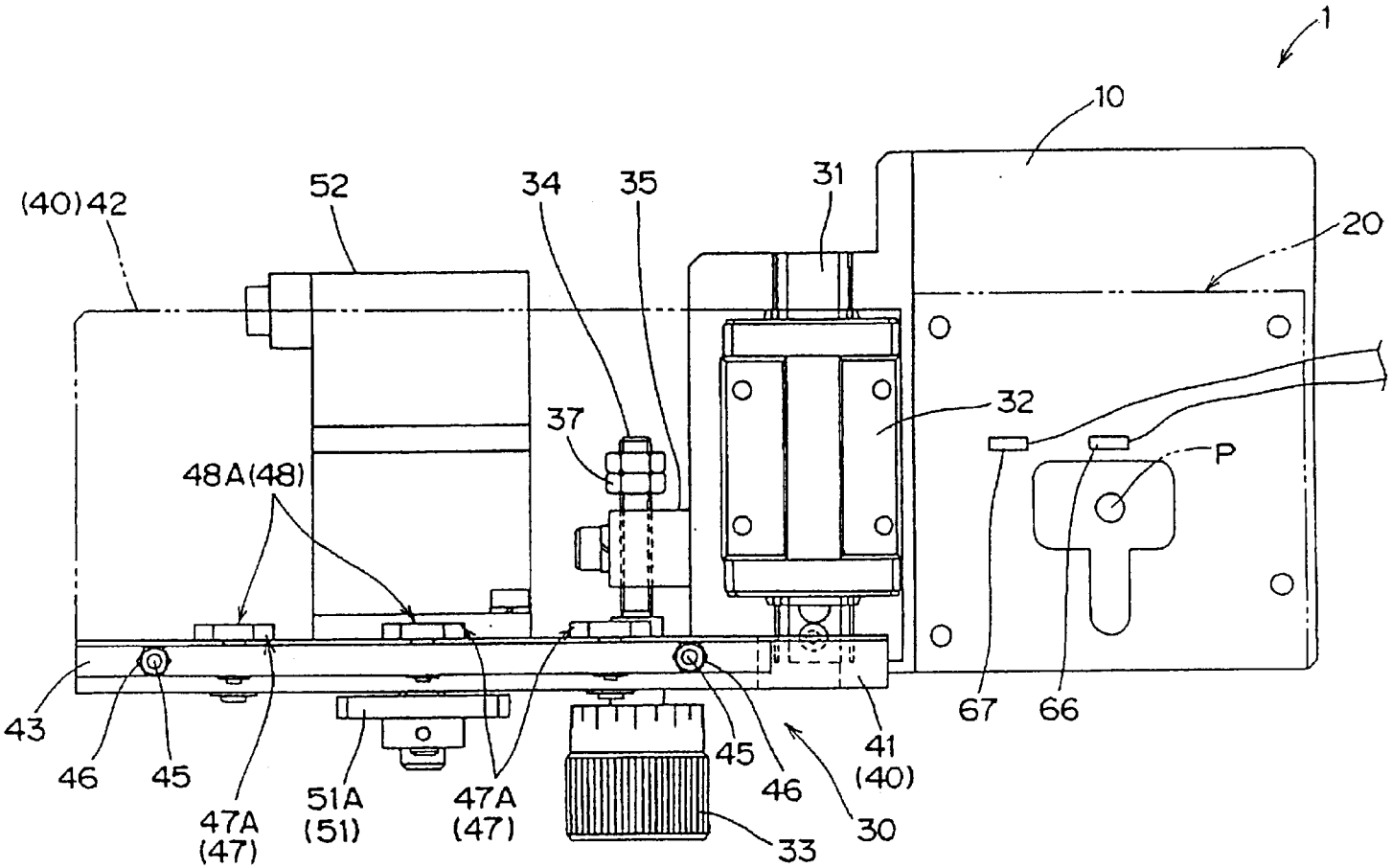
FIG. 7 is a simplified view of the terminal crimping unit of FIG. 5.
Figure 8:
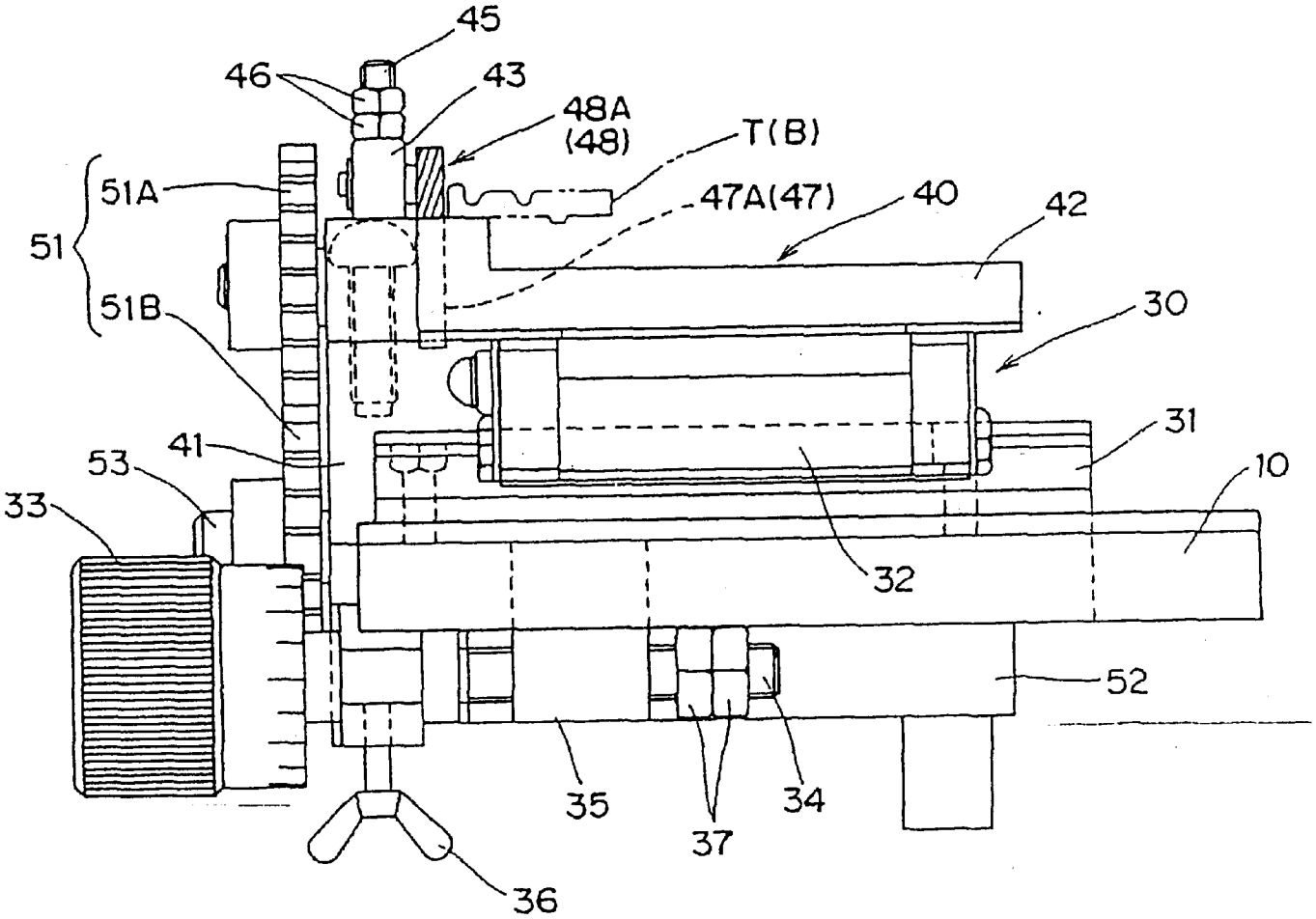
FIG. 8 is the right side cross-sectional view of the terminal crimping unit of FIG. 5.

FIG. 7 is a simplified view illustrating a part of the terminal crimping unit 1 of FIG. 5. FIG. 8 is the right side cross-sectional view of the terminal crimping unit 1 of FIG. 5.

Referring to FIG. 5, FIG. 7 and FIG. 8, the connection mechanism 30 is equipped with the guide rail 31 fixed on the upper end part of base plate 10. The liner slider 32 moves forward and backward along a horizontal direction along guide rail 31. The details of the connection mechanism 30 do not form part of the present invention and thus will not be described in great detail herein.

To make fine adjustments to the relative position between the terminal belt feed mechanism 40 and the press mechanism 20, the bolt 34 having a knob 33 is positioned on the front edge part such that it is able to rotate against the front board 41 of the terminal belt feed machine mechanism 40. The bolt 34 is threaded in the nut 35 that is fixed on the base plate 10. The feed mechanism is fin-tuned by turning the knob 33 which changes the threaded location of the bolt 34 and the nut 35. Further, as shown in FIG. 8, the bolt 34 is usually prevented from turning by equipping the nut 35 with the set screw 36. The terminal belt feed mechanism 40 is designed to be fixed on the base plate In the end part of the bolt 34, the twin nuts 37 are fixed and control the separation of the bolt 34 from the nut 35.

In one preferred embodiment, when the pressuring unit 24 and the pressure-receiving unit 25 are changed according to the type of the terminal fittings T, it is possible to make a fine adjustment between the feeding position of the terminal belt B in response to each change in pressuring units 24. Thus, the universal nature of the terminal crimping unit 1 is improved still more.

As shown in FIG. 5 and FIG. 6, the terminal belt feed mechanism 40 is assembled with the front board 41 as one body and includes the guide plate 42 for guiding the terminal belt B and the mobile guide 43 affixed to the guide plate 42.

As shown in FIG. 5, the front board 41 is preferably made of metal and includes the horizontal part 41A extending in the direction of feeding of the terminal belt B. Installation part 41B extends down from one part of horizontal part 41A. The front board 41 further includes the bolt 34 of the connection mechanism 30 that is installed at the lower end part of the installation part 41B. Further, as shown in FIG. 6, the receiving face 4 IC that receives the terminal belt B is on the upper face of the horizontal part 41 A as viewed in cross-section.

The guide plate 42 is formed in a long and approximate rectangular shape. The guide plate 42 includes a step part 42A wherein the front end side is formed to extend upward. As shown in FIG. 5, at the front edge of the face of the step part 42A, the horizontal part 41A of is affixed to the front board 41 by the bolt 44. The upper face of the step part 42A is positioned in the same plane as the receiving face 41C. The upper face of the step part 42A receives one part of the terminal belt B in cooperation with the front board 41. The height H of the step part 42A is positioned at a height that causes no interference with the stabilizer T5 of a plural type of the terminal fittings T capable of being crimped by the press mechanism 20. Thus, it is possible to feed a plural type of terminal belt B.

As shown in FIG. 6, the mobile guide 43 is preferably constructed of metal and formed in an approximate square shape along the longitudinal axis of the horizontal part 41A of the front board 41. The mobile guide 43 is affixed by the bolt 45 and the nuts 46 on the horizontal part 41A. Further, the mobile guide 43 includes the protruding face 43A positioned at the edge T7. The protruding face 43A cooperates with the receiving face 41C to continue guiding the long carrier T4 with the terminal fittings T along the linear feeding direction.

Figure 9:
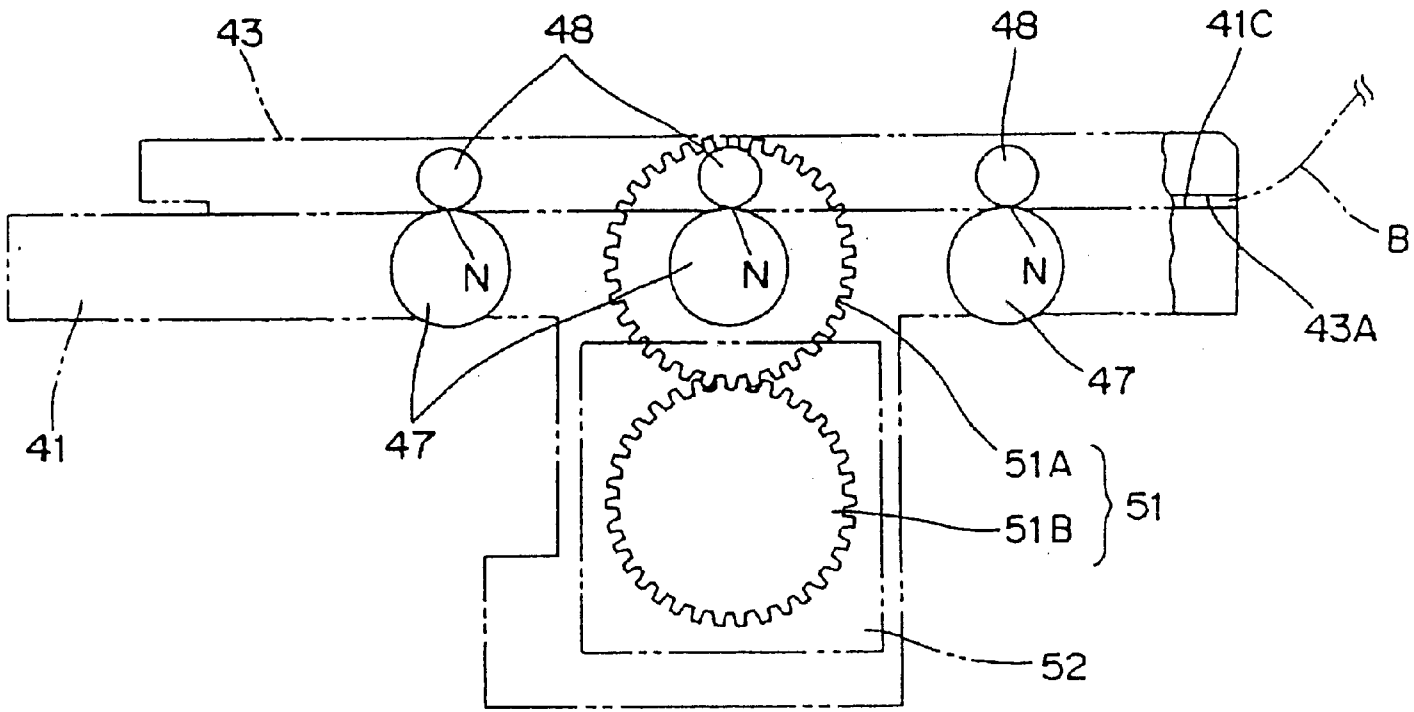
FIG. 9 is a rear view of one part of the terminal belt feed mechanism of the terminal crimping unit of FIG. 5.

FIG. 9 is a schematic view of part of the terminal belt feed mechanism 40 of the terminal crimping unit 1 of FIG. 5. As shown in FIG. 9, there are three feed rollers 47 on horizontal part 4 1A of the front board 41 and affixed on the guide plate 42. The three feed rollers 47 are arranged to be installed at certain intervals along the terminal feeding direction. As shown, the pressure rollers 48 and the feed rollers 47 that are installed at the mobile guide 43 are nipping the terminal belt B.

Figure 10:
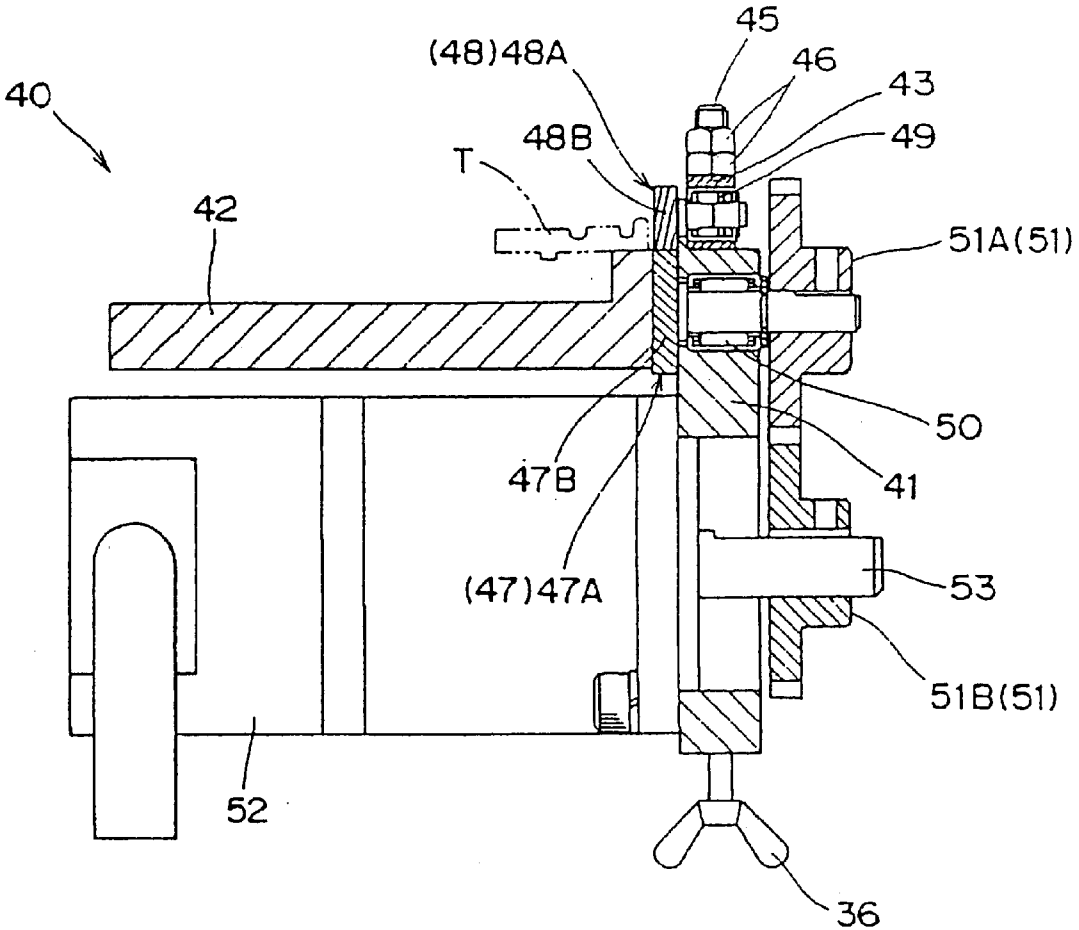
FIG. 10 is a left side view of the terminal belt feed mechanism of the terminal crimping unit of FIG. 5.

FIG. 10 is the left side view of the terminal belt feed mechanism 40 adapted to the terminal crimping unit 1 of FIG. 5. Referring to FIG. 10 and FIG. 9, each of the respective rollers 47, 48 is supported by the front board 41 or the mobile guide 43 through the bearings 49, 50. The rollers 47, 48 form the nip N nipping the carrier T4 by mutually rolling and contacting the carrier T4 as shown in FIG. 9.

Further, a "bevel slit" 47B is formed in the rolling part 47A of the feed rollers 47. On the other hand, the screw groove 48B is formed within the face of the rolling part 48A of the pressure rollers 48. In the preferred embodiment of the invention, the bevel slit 47B and the screw groove 48B are examples for feeding in the feeding direction while also guiding the carrier T4 towards the protruding face 43A of the mobile guide 43. The bevel slit 47B and the screw groove 48B bite the carrier T4 in the preferred embodiment shown, thus, they are designed to act with more force on the carrier T4 at the protruding face 43A. Further, the bevel slit 47B and the screw groove 48B can be adapted to increase the biting power by allowing the carrier T4 to more securely contact the bevel slit 47B and the screw groove 48B during feeding. The carrier T4 is easily taken off and put on, by either loosening or tightening the bolt 45 that affixes the mobile guide 43. When the bevel slit 47B and the screw groove 48B are adapted to encroach further upon the carrier T4, the carrier T4 becomes more susceptible to damage, but this is no hindrance because the carrier T4 is scrap material.

In the preferred embodiment described above including the rollers 47, 48, the terminal belt B can be fed regardless of the kind of terminal fittings T used. Thus, the guided terminal belt B can be used universally.

As shown in FIG. 5, FIG. 9, and FIG. 1, the preferred embodiment of the invention further includes the servomotor 52 that is connected to one of the feed rollers 47. In the preferred embodiment shown in FIG. 9, the servomotor 52 is arranged such that it is installed in the center. The servomotor 52 is connected to one of the feed rollers 47 through the gear mechanism 51 by which the driving force of the servomotor 52 is transferred to the feed rollers 47. The gear mechanism 51 is arranged on the front of the front board 41, and includes the input gear 51A affixed to the shaft of a feed roller 47 and the output gear 51B that engages the input gear 51A. By affixing the output gear 51B on the motor shaft 53 of the servomotor 52, the rotation power of the servomotor 52 is designed to transfer to feed roller 47 at a rotation ratio of 1:1.

The servomotor 52 is well-known, and is affixed to the back face of the installation part 41B of the front board 41. The motor shaft 53 penetrates the installation part 41B and extends forward. The motor shaft 53 is connected to the output gear 51B engaged with the input gear 51A in front of the installation part 41B. The control unit 60 links the drive power from the servomotor 52 to the press mechanism as described later.

Figure 11:
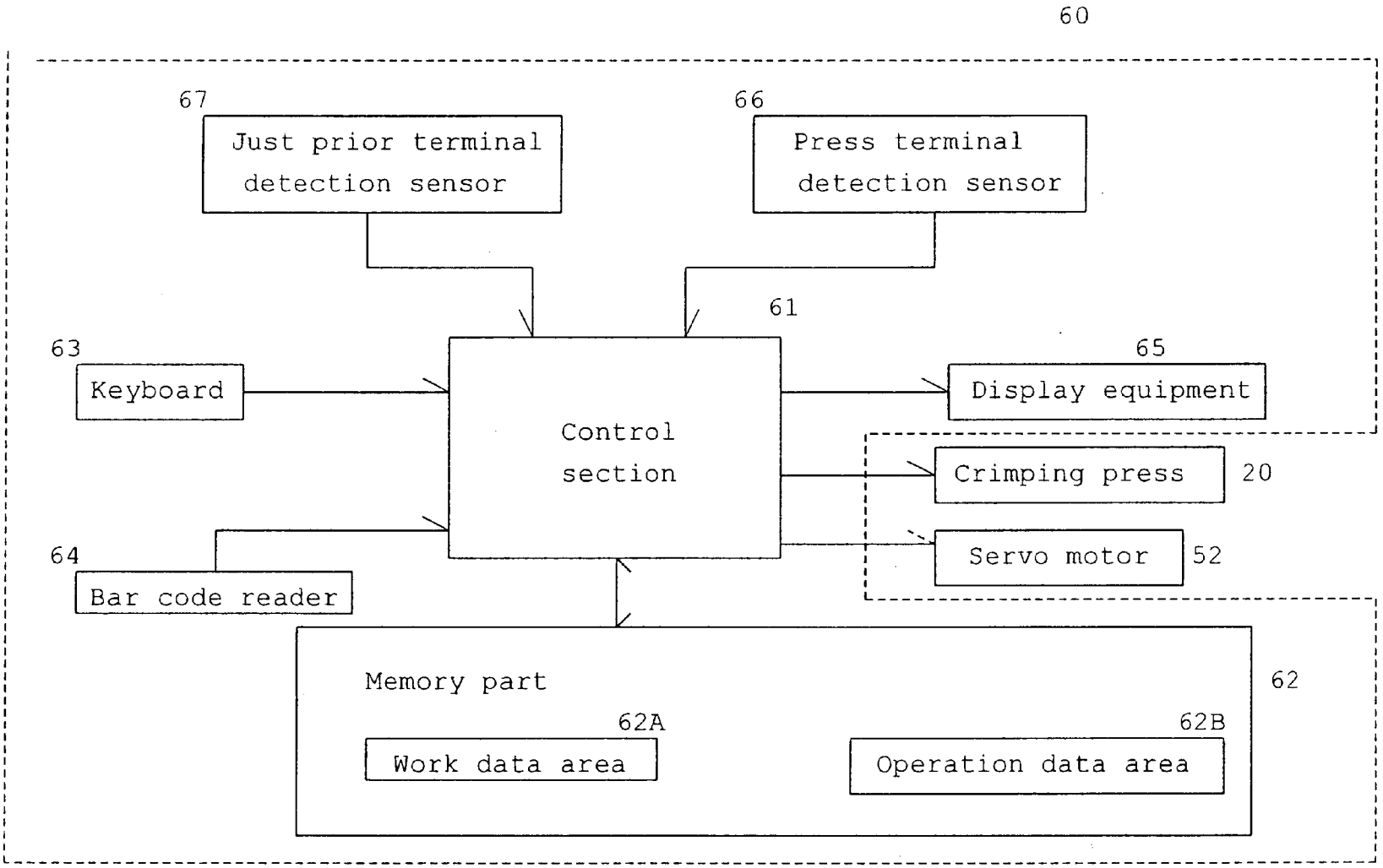
FIG. 11 is a block diagram of the control equipment for controlling the automatically length-adjusted electric wire manufacturing equipment of the terminal crimping unit of FIG. 5.

FIG. 11 is the block diagram of the control equipment that controls the automatically length-adjusted electric wire manufacturing equipment to which the terminal crimping unit 1 of FIG. 5 is adapted.

As shown in FIG. 11, the control unit 60 distinctly includes functional elements such as a microcomputer, I/O port and the like, and has the memory part 62 and the control section 61. The memory part 62 stores the crimping data required for feeding and crimping the terminal fittings for every type of terminal fitting T which should be crimped. The data stored in the memory part 62 includes the work data, which includes the power feed for the terminal belt for feeding and crimping the individual terminal fittings T, and the operation data and the like for controlling the respective mechanisms 20, 40 and the like in response to the work data for each terminal fitting T. Contained in the memory part 62, is the work data area 62A, dedicated to memorizing the work data, and the operation data area 62B, dedicated to memorizing the operation data.

For example, the keyboard 63 is connected to the control unit 60. The keyboard 63 is designed to enable one to input and change the work data, the operation data and the like.

The bar code reader 64 is connected to the control unit 60. As schematically shown in FIG. 5, the bar code reader 64 reads the bar code Fl as article number data from the pictured tag F. The article number data medium represents the article number for the length-adjusted electric wire (electric wire harness) that relates to the terminal fittings T which should be crimped. Based on the article number data read, the amount of feed is determined by the work data area 62A identifying the work data of the terminal fittings T (terminal belt B) and reading the operation data based on the work data identified. Based on the flow chart discussed later, the control section 61 is devised to be able to operate respective mechanisms 20, 40 and the servomotor 52.

As shown in FIG. 11, the display equipment 65 is connected to the control section 61. The display equipment 65 describes the individual controls and any abnormal information in the display equipment 65.

As shown in FIG. 7, the control unit 60 includes the press terminal detection sensor 66 that detects the arrangement of the terminal fittings T with respect to the terminal crimping position of the press mechanism 20 (the location where the terminal fittings T are crimped by the pressuring unit 24 and the pressure-receiving unit 25). The control unit 60 further includes the just prior terminal detection sensor 67 for detecting the terminal fittings T. The just prior terminal detection sensor 67 is positioned in front of the terminal crimping position. The sensors 66, 67 are capable of detecting the proximity of articles by connecting opto-electronics devices with an optical fiber.

Figure 12:
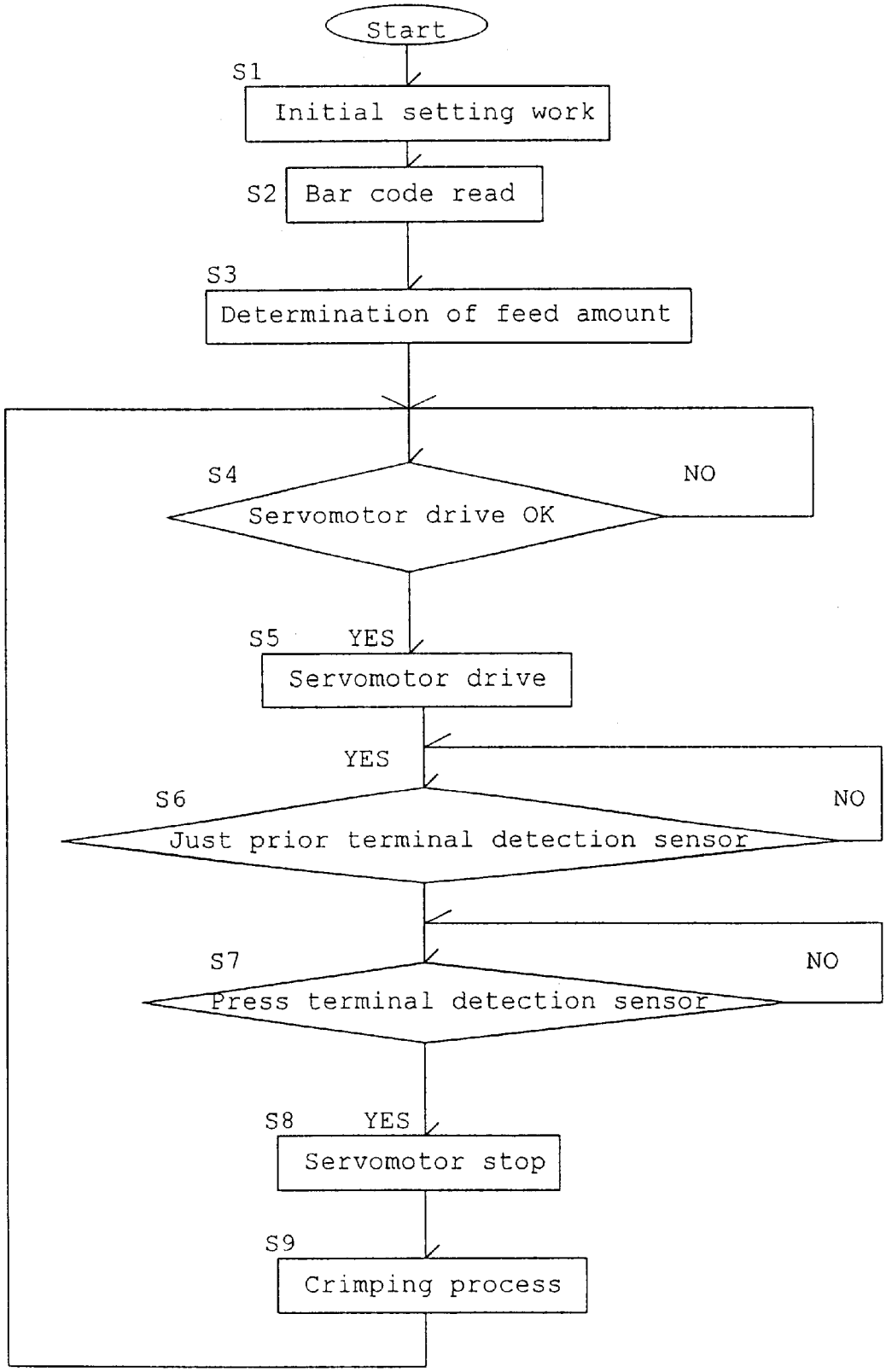
FIG. 12 is a flow chart showing the activating step of the terminal crimping unit of FIG. 5.

FIG. 12 is a flow chart that shows the activating step of the terminal crimping unit 1 of FIG. 5. The initial setting work is performed in the step S1 as shown in FIG. 12. The initial setting work includes using the keyboard 63 of the control equipment 60 to perform the teaching work and further includes the work of setting the terminal belt feed mechanism 40, terminal belt B and the like. When the power feed is expended in this initial setting work, the control equipment 60 allows the respective mechanisms 20, 40 to move to the fixed home position.

The bar code performs the reading operation to identify the terminal fittings T so that the appropriate length-adjusted electric wire is produced in step S2 in accordance with the initial setting work. Based on the article number data read by the bar code reading operation, the control equipment 60 develops the crimping data, including the work data of the corresponding article number and the operation data in step S3, and determines the quantity of terminal belt B to feed.

In step S4, the control equipment 60 executes a previously input routine program that links the activation of the feed terminal belt B with other mechanisms and waits for the drive timing of the servomotor 52. In step S5, the drive timing of the servomotor 52 is driven by receipt by the servomotor 52 of the quantity of feed that was determined in step S3.

In step S6, it is first determined whether the just prior terminal detection sensor 67 is switched OFF or not. After the just prior terminal detection sensor 67 is switched OFF in step S7, it is determined whether the terminal press detection sensor 68 is switched ON or not. Regardless of the quantity of feed determined in step S4, step S6 and step S7 are executed, and when the terminal press detection sensor 66 is switched ON after the just prior terminal detection sensor 67 is switched OFF, the rotation of the servomotor 52 is stopped (step S8), regardless of the quantity of feed determined in step S4. In step S9, the crimping process of the terminal fittings T is executed in a manner similar to conventional equipment, and the control relating to the servomotor 52 returns to step S4.

In the preferred embodiment discussed above, because it is possible to feed the terminal belt B when the terminal belt can be automatically separated from the press mechanism 20, it is possible to manage the terminal belt by only changing the press mechanism 20 if one is changing the type of the terminal fittings T. Thus, the terminal belt feed mechanism 40 can maintain its universal property. Further, the servomotor 52 is adapted by the adjusting operation which is performed whenever the type of terminal belt B is changed, thus, the quantity of feed of the terminal belt B can be easily adjusted by the terminal belt feed mechanism 40 simply by using the keyboard 63 to change the program as shown in FIG. 1. Thus, functionality and ease of operation is improved.

Accordingly, it is noticeably advantageous to provide a terminal belt feed mechanism 40 with improved functionality so that it is capable of maintaining the universal property of the terminal crimping unit 1. In particular, in one preferred embodiment, the carrier T4 is fed while being pushed to the protruding face 43A by the bevel slit 47B formed in the rolling parts 47A, 48A or the screw groove 48B. Thus, it is more difficult to remove the carrier T4 from the nip N of the roller pairs 47, 48. The difficulty in removing the carrier from the nip N of the roller pairs 47, 48 improves the reliability of the feed of the carrier T4 and improves the accuracy of the feed by preventing the carrier T4 from moving with respect to the protruding face 43A.

The invention is also advantageous by the bar code reader 64 determining the quantity of feed on the terminal belt B based on the bar code. Based on the determined quantity of feed, the servomotor 52 is driven. This is advantageous because it reduces the possibility of human error where there are many types, but small quantities, of products.

The system is also advantageous in that the current power feed information that is detected by the sensors 66, 67, is fed back into the servomotor 52 control according to step S6 and step S7. Thus, the carrier T4 is more accurately fed without excess wire or insufficient wire, even if the actual quantity of feed does not coincide with the quantity of feed stored in the memory part 62 of the control equipment 60.

Therefore, each preferred embodiment stated above effects a noticeable improvement in functionality by increasing the capacity of terminal crimping unit 1 to correspond to a greater number of types of terminal fittings T.

The embodiments shown and described are for illustrative purposes only and are not intended to limit the scope of the invention as defined by the claims. While the preferred embodiments of the invention have been illustrated and described, the present invention is not limited by the preferred embodiments as described and illustrated above. Various changes can be made therein without departing from the spirit and scope of the invention.

For example, the connection mechanism 30 shown in FIG. 5 can be applied to the terminal belt feed mechanism 4 of FIG. 1. Further, needless to say, various kinds of design changes are possible within the scope of the claims of the present invention.

As illustrated above, according to the present invention, as a plural number of the pressuring members containing a crimper can be put on and taken off as a unit against the shank by putting on and taking off the shank against the frame body. The replacement and maintenance of the pressuring members of the crimper and the like can be easily performed by preparing the unified pressuring member as a plural assembly of pressuring units in accordance with a type of the terminal fittings which should be crimped.

Because the terminal belt can be fed regardless of the type of the terminal fittings, the universal property of the guided terminal belt can be designed.

Further, it is possible to feed the terminal belt in a state of being automatically divided from the pressure-receiving unit and the pressuring unit that make up the press mechanism. This is possible by only changing the press mechanism 20 when changing the type of the terminal fittings T, thus maintaining the universal nature. Further, because the servomotor 52 is responsive to the adjusting operation which is performed whenever the type of terminal belt is changed, the quantity of feed of the terminal belt can be easily adjusted by the terminal belt feed mechanism simply by altering the program. Thus, functionality is improved.

Further, in another aspect of the preferred invention, in changing the pressure-receiving unit and the pressuring unit according to a type of terminal fittings, the feeding position of the terminal belt can be finely adjusted according to the respective units changed. Thus, the universal nature of the terminal crimping unit is further improved.

In another aspect of the invention, the terminal crimping work is preformed by alternatively utilizing a plural number of pressure-receiving faces formed on the same anvil. Thus, the universal nature of the pressure-receiving unit is improved by having fewer components.

Therefore, the present invention noticeably improves the functionality of the terminal crimping unit.

The present disclosure relates to subject matter contained in Japanese Application No. 8-202444 filed on Jul. 31, 1996, which is expressly incorporated herein by reference in its entirety.

What is claimed is:

1. A terminal crimping unit for crimping terminal fittings, the terminal crimping unit comprising:

a plurality of pressure members including at least one crimper for crimping terminal fittings, each of said pressure members including a stackable plate portion;

a frame body supporting the pressure members, said frame body including a front plate and a back plate substantially parallel to one another, between which all of the stackable plate portions of the plurality of pressure members are stacked substantially parallel to one another;

at least one first fastener that secures the pressure members between the front plate and the back plate of the frame body to form a removable unit;

a shank for driving the frame body and pressure members to move together in a pressing motion;

a second fastener for removably connecting the removable unit to said shank;

a pressure-receiving unit including a recess part; and an anvil for receiving the terminal fittings and supporting the terminal fittings against pressure applied by said pressure members for crimping the terminal fittings, said anvil being shaped to removably fit into said recess part, wherein said anvil includes at least two pressure-receiving faces, each having a shape different from the other, to correspond to at least two different types of terminal fittings, said at least two different pressure receiving faces being on different orthogonal ends of said anvil, and said recess part being shaped to accept said anvil in at least two alternative orientations of said anvil, only one of said at least two different pressure receiving faces of said anvil being at the crimping position of the terminal fittings for each alternative orientation of said anvil.

2. The terminal crimping unit according to claim 1, said at least two different pressure-receiving faces being on opposite orthogonal ends of said anvil.

3. The terminal crimping unit according to claim 1, wherein said front plate is unitarily formed with one of said pressure members, said front plate and said one of said pressure members being fixed relative to one another.

4. The terminal crimping unit according to claim 3, wherein said front plate is unitarily formed with a cutting punch, said front plate and said cutting punch being fixed relative to one another.

5. A terminal crimping unit according to claim 1, further including:

a receiving face for receiving a terminal carrier, said terminal carrier including spaced and parallel terminal fittings;

a protruding face extending in a direction perpendicular to said receiving face for contacting a side edge of said terminal carrier;

and a roller having a contact part contacting said terminal carrier and feeding said terminal carrier to said anvil of said pressure-receiving member and clamping the terminal carrier between said contact part and said protruding face.

6. A terminal crimping unit according to claim 1, comprising:

a pair of rollers clamping a terminal carrier, said terminal carrier including spaced and parallel terminal fittings;

a servomotor driving one of a pair of rollers so that said pair of rollers feeds said terminal carrier to said anvil of said pressure-receiving member;

a controller for controlling the rotation of said servomotor so that said terminal fittings are fed when the terminal crimping unit is not engaged.

7. A terminal crimping unit according to claim 1, comprising:

a terminal carrier feed mechanism for feeding a terminal carrier, said terminal carrier including spaced and parallel terminal fittings;

a base plate;

a guide rail positioned at one end of said terminal carrier feed mechanism and extending toward a direction perpendicular to said terminal carrier, said guide rail connected to one of said terminal carrier feed mechanism and said base plate;

a slider that slides along said guide rail, said slider connected to the remaining one of said terminal carrier feed mechanism and said base plate; and a lock mechanism for adjusting the relative position of the slider and the guide rail, and thereby the relative position of said base plate and said terminal carrier feed mechanism.

8. A terminal crimping unit for crimping terminal fittings, the terminal crimping unit comprising:

a removable unit including a plurality of pressure members and at least one crimper for crimping terminal fittings;

a shank for accepting said removable unit and driving the removable unit to move in a pressing motion;

a fastener for removably connecting the removable unit to said shank;

a pressure-receiving unit toward which said removable unit is driven, said pressure-receiving unit including a recess part; and an anvil for receiving the terminal fittings and supporting the terminal fittings against pressure applied by said pressure members for crimping the terminal fittings, wherein said anvil comprises at least two pressure-receiving faces, each having a shape different from the other to correspond to at least two different types of terminal fittings, said at least two different pressure-receiving faces being on different orthogonal ends of said anvil, said recess part being shaped to accept said anvil in at least two alternative orientations of said anvil, only one of said at least two different pressure-receiving faces of said anvil being at the crimping position of the terminal fittings for each alternative orientation of said anvil.

* * * * *